United States Patent [19]

Morsy

[11] Patent Number: 5,066,521

[45] Date of Patent: Nov. 19, 1991

[54] COMPOSITION AND PROCESS FOR COATING SYNTHETIC FIBERS

[75] Inventor: Esam M. Morsy, Peoria, Ariz.

[73] Assignee: Barbara Blair Reiter, New York, N.Y.

[21] Appl. No.: 546,912

[22] Filed: Jul. 2, 1990

[51] Int. Cl.[5] ..... B05D 3/02

[52] U.S. Cl. ..... 427/387; 427/389.9; 427/421; 428/266; 428/267

[58] Field of Search ..... 427/389.9, 387, 421; 428/266, 267

[56] References Cited

U.S. PATENT DOCUMENTS 4,752,496 6/1988 Fellows et al. ..... 427/391 X 4,917,920 4/1990 Ono et al. ..... 427/389.9 X

*Primary Examiner*—Michael Lusignan

*Attorney, Agent, or Firm*—Antonio R. Durando; Harry M. Weiss

[57] ABSTRACT

The use of clear polymeric substances, such as polyvinyl pyrrolidone and silicone resins, polyvinyl pyrrolidone/acrylates copolymers, polyvinyl methacrylate/methacrylic acid copolymers, and polyvinyl acetate resins to coat nylon and similar fabrics, thus providing a protective film that greatly increases the strength of the fiber. These polymers can be packaged in spray form, using an alcohol base as carrier. The coating can then be applied directly to the finished article by the consumer by spraying the fabric with the alcohol solution of the protective substance.

22 Claims, No Drawings

COMPOSITION AND PROCESS FOR COATING SYNTHETIC FIBERS

BACKGROUND OF THE INVENTION

1. Field of the Invention

This invention pertains to the general field of chemical substances used to coat fabric fibers in order to enhance their performance and durability. In particular, it provides a new and improved way of applying a polymeric film designed to improve the appearance and resistance of nylon and similar synthetic fabrics.

2. Description of the Prior Art

Thin fiber fabrics are very susceptible to wear and damage when they come into contact with abrasive materials and sharp objects. Synthetic fibers, such as nylon, also tend to be sensitive to the environmental stresses to which they are subjected while in use. These include heat, ultraviolet radiation and, in the case of garments, body perspiration.

The problem of fabric deterioration is particularly relevant with nylon stockings and with clothes in general because of their continuous exposure to the sources of damage mentioned above. When a fiber is severed, the integrity of the entire fabric is affected and the resulting damage propagates to the surrounding areas, thus effectively destroying the remaining utility of the garment.

Therefore, any product that increased the resistance of fabrics and reduced the possibility of fiber rupture would be extremely useful and desirable. Just as fabrics are protected against staining by coating them with a film of insulating material, such as "Scotch Guard" and similar products, it has been found that they can be strengthened as well by depositing a layer of synthetic polymer on their fibers. The purpose of this invention is to define a feasible and practical composition and method for the application of such polymers to fabrics directly by consumers.

One of the polymers used with most success as a protective additive in many industries is constituted by polyvinyl pyrrolidone (PVP) and its copolymers. Now recognized not merely as an additive, but as an integral part of many different products, PVP is used to improve the physical properties of many products in the fields of cosmetics, textiles, adhesives and paper. With reference to textiles, PVP is used as a backbone for grafting monomers in the production of fibers with improved dye receptivity and antistatic properties. The polymer may also be incorporated by surface grafting or during spinning by impregnation of the wet-spun fibers. Similar results can be obtained by coating the polymer on the outside of a hydrophobic fiber. In textile finishing, PVP is used in sizing, in delustering, and in other finishing operations. Certain copolymers with acrylates and vinyl acetates have also been used for specific applications.

BRIEF SUMMARY OF THE INVENTION

This invention consists of the use of clear polymeric substances, such as polyvinyl pyrrolidone, some of its copolymers, and silicone resins, to coat nylon and similar fabrics, thus providing a protective film that greatly increases the strength of the fiber. These polymers can be packaged in spray form, using an alcohol base as carrier. The coating can then be applied directly to the finished article by the consumer by spraying the fabric with the alcohol solution of the protective substance.

One objective of the invention is the coating of the fabric with a substance that will enhance its wear and durability without affecting its texture and appearance. This is achieved by the use of a combination of clear polymeric substances of proven chemical and physical properties.

Another goal of the invention is the availability of a product that can be applied to fabrics by consumers in a home environment in a non-hazardous and practical way. Therefore, the product is made available in spray form using a combination of nontoxic ingredients commonly used by the pharmaceutical and the cosmetic industries and approved by the appropriate governmental agencies.

A further objective of this invention is the development of a polymer composition that remains stable in liquid form and that is suitable for spray application. Various other purposes and advantages of this invention will become clear from its description in the specifications that follow, and from the novel features particularly pointed out in the appended claims.

Therefore, to the accomplishment of the objectives described above, this invention consists of the features hereinafter illustrated in the examples, fully described in the detailed description of the preferred embodiment and particularly pointed out in the claims. However, such examples and description disclose but one of the various ways in which the invention may be practiced.

DETAILED DESCRIPTION OF THE INVENTION

The heart of this invention lies in the discovery that known chemical substances, routinely used in industry to provide protective coatings to various materials, can successfully be applied to fabric products directly by consumers in a home environment. The process and chemical composition described below are specifically designed for spray application on fabrics and articles of clothing.

It is found that the physical and chemical characteristics of polyvinyl pyrrolidone are particularly suited for this application. PVP is a white, amorphous powder that produces clear solutions in water and organic solvents. It is compatible with a wide range of hydrophilic and hydrophobic resins, hygroscopic and low in toxicity. When applied to a fiber, its solutions produce a transparent film that adheres to the substrate and coats it with a resilient protective layer. The film is strong, durable and smooth, which all contribute to its usefulness as a protective coating for nylon and other nonwoven fibers. Because of their higher degree of porosity, woven fibers tend to constitute a less stable substrate for the protective film, resulting in less permanent protection.

Because of PVP's compatibility with other resins, it can be combined with other, less expensive resins without material loss of performance in order to reduce the cost of the final product. In fact, some resins actually improve the strength of the PVP coating. For example, it has been found that silicone resins provide a very good source for such a secondary material without altering the physical properties of the protective film. Silicone resins are all excellent film forming compositions, both in solution and emulsion form, with strength and resilience properties similar, and in some formulations even superior, to those of PVP. They are used as coatings for leather, masonry and other articles exposed to weather and heat. They are also used a strengthening additives for paints and protective formulations in general.

Because of its compatibility with both PVP and silicone resins, isopropyl alcohol is the preferred carrier to form the solution that is the basis o this invention. This solution is suitable for spraying and the high volatility of the alcohol is suitable for rapid drying and curing of the resin layer after spraying on the fabric. Ethanol can also be used, either as a substitute or in conjunction with isopropyl alcohol, and all formulations given below in terms of isopropyl alcohol can be expressed equivalently in terms of ethanol. The presence of either alcohol produces a stabilizing effect to the resin solution, so that no additional preservatives are necessary to prevent the development of mold, or similar growth, to increase the shelf life of the product. It has also been found that combinations of PVP/acrylates copolymers, such as polyvinyl pyrrolidone/tertiary-butyl acrylate, with methacrylic acid are effective in achieving the same coating and protective properties of PVP, particularly when the preparation is for aerosol applications. The copolymer of PVP/acrylates with methacrylic acid is available commercially under several trade names (e.g., BASF Corporation's "Luviflex VBM 35") and in various concentrations.

Finally, it is found that the addition of coloring and fragrance may be useful in order to enhance consumer acceptance and the attractiveness of the product in its package. A typical formulation for this invention and procedure for its manufacture are given in the example below.

EXAMPLE 1

| Component | Weight Percent |
|---|---|
| PVP solids | 4.50 |
| Silicone resin | 0.08 |
| Isopropyl alcohol | 84.27 |
| Purified water | 11.00 |
| Fragrance | 0.15 |
| Dye | quantum sufficit |
| Total | 100.00 |

The product was prepared in an enclosed, inert vessel equipped with a variable speed mixer. Based on a total of 100 parts by weight, 84.27 parts of alcohol were first introduced into the vessel at room temperature and atmospheric pressure. With the mixer producing a moderate rate of agitation in order to avoid unnecessary evaporation of the alcohol, the corresponding 4.50 parts of PVP resin were added and mixed until a completely uniform solution was obtained. The step was then repeated while adding the 0.08 parts of silicone resin solution. Water was added in the given proportionate amount (11.00 parts) and the solution mixed for about 20 minutes until it became completely clear. Finally, coloring certified by the Food, Drug and Cosmetics (FD & C) agency of the U. S. government and fragrance were added to the solution to suit the desired appearance and mixed in for approximately ten minutes. The resulting solution was found to be ready for immediate application or for containerization for future use. Because of its alcoholic base, the solution also proved to be directly suitable for pump-up spray applications.

So long as the relative proportions of the components are respected, the composition of Example 1 can be prepared in batches of any size. The only practical limitation is in the size and operation of the equipment. All components used in Example 1 are readily available in the open market. PVP is produced in various molecular weights, from 10,000 to 360,000, depending on the degree of polymerization and on whether or not it is combined with other organic groups. While all can be used to practice this invention, some of the products used in this instance were poly-(vinyl pyrrolidone/vinyl acetate) and monobutyl esther of poly-(methyl vinyl ether/maleic acid), sold in clear ethanol solution by GAF Chemical Company under the trade designations of "PVP/VA 735" and "Gantrez ES" resins, respectively; and the copolymers of PVP/acrylates, sold by BASF Corporation under the mark of "Luviflex VBM" resins.

Silicone resins are available in isopropyl alcohol or in aromatic solvent solutions, as well as in aqueous emulsions. The product used in this example is sold by Genesee Polymers Corporation under the trade designation "GP-187 Silicone Resin Solution" and it is an isopropyl alcohol solution of methyl silicone resin. This is the preferred form of silicone solution because of its lower toxicity than aromatic solutions and its homogeneity with the preferred carrier for the invention, isopropyl alcohol. This alcohol is itself available as an open market commodity in 99.0 percent pure form under a variety of trade names.

Similar results were achieved with the same procedure with variable amounts of each component, within the following approximate ranges of weight percentages:

| Component | Weight Percent |
|---|---|
| PVP solids | 0.50–10.00 |
| Silicone resin | 0.01–1.00 |
| Isopropyl alcohol | quantum sufficit |
| Purified water | 0.00–20.00 |
| Fragrance | 0.01–0.20 |
| Dye | quantum sufficit |
| Total | 100.00 |

Greater percentages of resins produce a thicker and glossier coating film, at the expense of elasticity and washability of the finished product. Therefore, the amounts are chosen within these approximate ranges according to the desired product characteristics.

Another example of a composition according to this invention is illustrated by the formulation given below, where the main protective ingredient is constituted by polyvinyl acetate (PVA) resins instead of PVP. These resins are clear and soluble in most organic solvents. They are used in paper coating, textile finishing, and as additives for adhesives and paints. The protective properties of the product resulting from the combination described below are equivalent to those of the product described in Example 1.

EXAMPLE 2

| Component | Weight Percent |
|---|---|
| PVA solids | 4.50 |
| Silicone resin | 0.08 |
| Isopropyl alcohol | 84.27 |
| Purified water | 11.00 |
| Fragrance | 0.15 |
| Dye | quantum sufficit |

-continued

| Component | Weight Percent |
|---|---|
| Total | 100.00 |

The product is prepared in an enclosed, inert vessel equipped with a variable speed mixer. The required amount of alcohol is first introduced into the vessel at room temperature and pressure. With the mixer producing a moderate rate of agitation, the corresponding amount of polyvinyl acetate resin is added and mixed until a completely uniform solution is obtained. The step is then repeated while adding the silicone resin solution. Water is added in the proportionate amount and mixed in until the solution becomes completely clear. Finally, the coloring and fragrance are added and mixed in for approximately ten minutes. The resulting solution is ready for encapsulation in cans or other suitable container for direct pump-up spray applications.

Similar results are achieved with the same procedure with variable amounts of each component, according to the following approximate ranges of weight percentages:

| Component | Weight Percent |
|---|---|
| PVA solids | 0.50–10.00 |
| Silicone resin | 0.01–1.00 |
| Isopropyl alcohol | quantum sufficit |
| Purified water | 0.00–20.00 |
| Fragrance | 0.01–0.20 |
| Dye | quantum sufficit |
| Total | 100.00 |

In addition to PVA, there are various copolymer products of PVP that are commercially available and found to be very suitable for the compositions of this invention. Copolymers of PVP/acrylates with methacrylic acid or maleic acid are the most preferred because of the superior esthetic properties of the dried film obtained by spraying them in proper proportions and in a proper vehicle on the fabric substrate.

Those skilled in the art may add a reasonable level of a suitable plasticizer to any of the polymeric compositions described herein in order to modify the elastic properties of the film, as desired for particular purposes. One example of such suitable plasticizers is dioctyl sebacate, which is available from the Union Camp Corporation under the trade designation "Uniflex DOS," from The C. P. Hall Company under the mark "Plasthall DOS," and from the Dow Corning Corporation as "Dow Corning 190 Surfactant"; another example is diethyl phthalate, available under BASF's mark "Palatinol."

In addition to plasticizers, a long-chain fatty amine may be used, particularly in cases where higher levels of resin solids have been used. The function of the fatty amine is to enhance the neutralization of the acid portion of the copolymeric resin and, more importantly, to enhance the washability of old resin films between applications, so that resin film buildup can be avoided or minimized. When it becomes necessary to reapply the coating of this invention to restore its integrity damaged by ordinary wear and tear, the presence of the amine results in a more uniform and smoother film because of its solvent action on the residue from the older coatings. An example of such an amine is distilled N, N-dimethyl-octadecyl-amine, produced commercially by Akzo Chemical, Inc. under the trade name of "Armeen DM18D."

In cases where copolymeric resins of PVP or polyvinyl methacrylate (PVM) containing methacrylic or maleic acids are used, neutralization of the acids is necessary for best results. The carboxyl groups contributed by such organic acids become an important part of the final net of polymeric film. Neutralizers therefore become very essential additives whenever acid-linked copolymers are used as the primary film-forming resin. Suitable neutralizers for this application include 2-amino 2-methyl 1-propanol (AMP), dimethylstearylamine (DMS), diethylaminopropylamine (DEPA), triisopropanolamine (TIPA), or any of the typical amino alcohols familiar to those skilled in the art. Inorganic alkali hydroxides, such as sodium or potassium hydroxides, or simple alkanolamines, such as triethanolamine (TEA), are also suitable.

The neutralization process is a stoichiometric one. The amount of neutralizer to be used in order to achieve the required degree of neutralization is dependent on the equivalent weight of both the neutralizer and the polymer. In the case of "Gantrez" polymer, for example, the number of grams of neutralizer required may be calculated by using the following formula:

$$\text{Weight of neutralizer} = \frac{Z \times n \times N_{eq}}{100 \times P_{eq}},$$

where

Z is the percentage of neutralization desired;

n is the total weight of polymer solids;

$N_{eq}$ is the equivalent weight of neutralizer; and $P_{eq}$ is the equivalent weight of polymer ("Gantrez").

The same can also be achieved by using the following alternative general formula:

$$\text{Weight of neutralizer} = \frac{n_1 \times Y \times Z \times A}{100},$$

where $n_1$, is the weight of 1 polymer supplied;

Y is the acid value of the 1 polymer;

Z is the percentage of neutralization desired; and

A is a neutralizer factor calculated as follows:

$$A = \frac{\text{eqivalent weight of neutralizer}}{\text{molecular weight of potassium hydroxide}}.$$

For example, for AMP A =1.59; for DEPA A =2.32; and for TIPA A =3.41.

As noted, the products of this invention are hydroalcoholic compositions of certain polymers and neutralized copolymers. While the alcoholic component is hydrophilic, the polymeric component is not and will separate when free water is present in the mixture. Therefore, the products of this invention can be diluted only to the extent that water will be absorbed b the alcohols in the mixture. The degree of neutralization of the copolymers also determines the amount of water that any of the copolymer-based systems can accept without clouding or precipitation. In general, more water can be added when a higher degree of neutralization exists.

For example, "Gantrex ES" copolymers at the recommended stoichiometric neutralization degree of 10% have excellent film-forming properties while maintaining good washability. The corresponding amount of usable water in the system is in the 10%–15% range. This may vary depending on other additives that may have been incorporated in the composition for film modification or other purposes. By contrast, another example is a system with ten percent "Luviflex VBM 35" (which consists of approximately 50% solids and, correspondingly, produces a finished product with a solids content of approximately 5% of total weight) neutralized to 80%, to which water can be added up to 50% of total weight.

Similar results can be achieved by using any of the following copolymers within the given ranges of weight percentages:

| Component | Weight Percent |
|---|---|
| PVP/acrylate copolymer solids or PVM/methacrylic acid copolymer solids | 1.00–15.00 |
| Neutralizer (e.g., AMP) | 0.10–1.00 |
| Plasticizer (e.g., DEP) | 0.10–1.00 |
| Isopropanol or ethanol | quantum sufficit |
| Purified water | 0.00–20.00 |
| Propellents (optional) | quantum sufficit |
| Fragrance and dye | quantum sufficit |
| | 100.00 |

A specific example of a composition according to this general formula is given below.

EXAMPLE 3

| Component | Weight Percent |
|---|---|
| Gantrez ES-225 solids | 15.00 |
| Dimethyl stearyl amine | 0.21 |
| Dioctyl sebacate | 0.10 |
| Ethanol | 74.54 |
| Purified water | 10.00 |
| Fragrance | 0.15 |
| Dye | quantum sufficit |
| Total | 100.00 |

In a procedure similar to the ones described above, this product was prepared in an enclosed, inert vessel equipped with a variable speed mixer. Based on a total of 100 parts by weight, 74.54 parts of alcohol were first introduced into the vessel at room temperature and atmospheric pressure. With the mixer producing a moderate rate of agitation in order to avoid unnecessary evaporation of the alcohol, 0.21 parts of dimethylstearylamine (neutralizer) and 0.10 parts of dioctyl sebacate (plasticizer) were added to the mixture. Then with higher mixing but still avoiding alcohol evaporation and air entrapment, the corresponding 15.00 parts of Gantrez ES-225 resin were added and mixed until a completely uniform and clear solution was obtained. Water wa then added in the given proportionate amount (10.00 parts) with the coloring dye (FD & C Red No.3) predissolved in it and the solution was mixed for about 20 minutes until it became completely clear. Finally, fragrance was added.

Modifications to this procedure to fit any of the formulations given above would be obvious to one skilled in the art. Furthermore, various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent compositions and methods.

I claim:

1. A method of forming a protective film over textile fibers, comprising the following steps:

(a) applying a coating to the fibers from a working solution having the following formulation:

| Component | Weight Percent Range |
|---|---|
| PVP solids | 0.50–10.00 |
| Silicone resin | 0.01–1.00 |
| Isopropyl alcohol | quantum sufficit |
| Purified water | 0.00–20.00 |
| Fragrance | 0.01–0.20 |
| Dye | quantum sufficit |
| Total | 100.00 |

wherein said coating is permitted to dry until the solvent has been substantially removed.

2. The method defined in claim 1, wherein said working solution is spray applied to the surface to be protected.

3. The method defined in claim 1, wherein the formulation of said working solution is more particularly described as follows:

| Component | Weight Percent |
|---|---|
| PVP solids | 4.50 |
| Silicone resin | 0.08 |
| Isopropyl alcohol | 84.27 |
| Purified water | 11.00 |
| Fragrance | 0.15 |
| Dye | quantum sufficit |
| Total | 100.00 |

4. The method defined in claim 3, wherein said working solution is spray applied to the surface to be protected.

5. A method of forming a protective film over textile fibers, comprising the following steps:

(a) applying a coating to the fibers from a working solution having the following formulation:

| Component | Weight Percent |
|---|---|
| PVA solids | 0.50–10.00 |
| Silicone resin | 0.01–1.00 |
| Isopropyl alcohol | quantum sufficit |
| Purified water | 0.00–20.00 |
| Fragrance | 0.01–0.20 |
| Dye | quantum sufficit |
| Total | 100.00 |

wherein said coating is permitted to dry until the solvent has been substantially removed.

6. The method defined in claim 5, wherein said working solution is spray applied to the surface to be protected.

7. The method defined in claim 5, wherein the formulation of said working solution is more particularly described as follows:

| Component | Weight Percent |
|---|---|
| PVA solids | 4.50 |
| Silicone resin | 0.08 |
| Isopropyl alcohol | 84.27 |
| Purified water | 11.00 |
| Fragrance | 0.15 |
| Dye | quantum sufficit |
| Total | 100.00 |

8. The method defined in claim 7, wherein said working solution is spray applied to the surface to be protected.

9. A method of forming a protective film over textile fibers, comprising the following steps:

(a) applying a coating to the fibers from a working solution having the following formulation:

| Component | Weight Percent |
|---|---|
| PVP/acrylate copolymer solids | 1.00–15.00 |
| Neutralizer | 0.10–1.00 |
| Plasticizer | 0.10–1.00 |
| Isopropanol | quantum sufficit |
| Purified water | 0.00–20.00 |
| Propellents (optional) | quantum sufficit |
| Fragrance and dye | quantum sufficit |
| | 100.00 |

wherein said coating is permitted to dry until the solvent has been substantially removed.

10. The method defined in claim 9, wherein said working solution is spray applied to the surface to be protected.

11. A method of forming a protective film over textile fibers, comprising the following steps:

(a) applying a coating to the fibers from a working solution having the following formulation:

| Component | Weight Percent |
|---|---|
| PVM/methacrylic acid copolymer solids | 1.00–15.00 |
| Neutralizer | 0.10–1.00 |
| Plasticizer | 0.10–1.00 |
| Isopropanol | quantum sufficit |
| Purified water | 0.00–20.0 |
| Propellents (optional) | quantum sufficit |
| Fragrance and dye | quantum sufficit |
| | 100.00 |

wherein said coating is permitted to dry until the solvent has been substantially removed.

12. The method defined in claim 11, wherein said working solution is spray applied to the surface to be protected.

13. A coated textile fiber prepared by applying over said fiber a working solution having the following formulation:

| Component | Weight Percent Range |
|---|---|
| polyvinyl pyrrolidone solids | 0.50–10.00 |
| Silicone resin | 0.01–1.00 |
| Isopropyl alcohol | quantum sufficit |
| Purified water | 0.00–20.00 |
| Fragrance | 0.01–0.20 |
| Dye | quantum sufficit |
| Total | 100.00 |

wherein said working solution is permitted to dry after application to said textile fiber until the solvent has been substantially removed.

14. The coated textile fiber defined in claim 13, wherein said working solution is spray applied to the surface to be protected.

15. The coated textile fiber defined in claim 13, wherein the percentage of each component in said working solution is more particularly described as follows:

| Component | Weight Percent |
|---|---|
| polyvinyl pyrrolidone solids | 4.50 |
| Silicone resin | 0.08 |
| Isopropyl alcohol | 84.27 |
| Purified water | 11.00 |
| Fragrance | 0.15 |
| Dye | quantum sufficit |
| Total | 100.00 |

16. A coated textile fiber prepared by applying over said fiber a working solution having the following formulation:

| Component | Weight Percent |
|---|---|
| polyvinyl acetate solids | 0.50–10.00 |
| Silicone resin | 0.01–1.00 |
| Isopropyl alcohol | quantum sufficit |
| Purified water | 0.00–20.00 |
| Fragrance | 0.01–0.20 |
| Dye | quantum sufficit |
| Total | 100.00 |

wherein said working solution is permitted to dry after application to said textile fiber until the solvent has been substantially removed.

17. The coated textile fiber defined in claim 16, wherein said working solution is spray applied to the surface to be protected.

18. The coated textile fiber defined in claim 16, wherein the percentage of each component in said working solution is more particularly described as follows:

| Component | Weight Percent |
|---|---|
| polyvinyl acetate solids | 4.50 |
| Silicone resin | 0.08 |
| Isopropyl alcohol | 84.27 |
| Purified water | 11.00 |
| Fragrance | 0.15 |
| Dye | quantum sufficit |
| Total | 100.00 |

19. A coated textile fiber prepared by applying over said fiber a working solution having the following formulation:

| Component | Weight Percent |
|---|---|
| polyvinyl pyrrolidone/acrylate copolymer solids | 1.00–15.00 |
| Neutralizer | 0.10–1.00 |
| Plasticizer | 0.10–1.00 |
| Isopropanol | quantum sufficit |
| Purified water | 0.00–20.00 |
| Propellents (optional) | quantum sufficit |
| Fragrance and dye | quantum sufficit |
| | 100.00 |

wherein said working solution is permitted to dry after application to said textile fiber until the solvent has been substantially removed.

20. The coated textile fiber defined in claim 19, wherein said working solution is spray applied to the surface to be protected.

21. A coated textile fiber prepared by applying over said fiber a working solution having the following formulation:

| Component | Weight Percent |
|---|---|
| polyvinyl methacrylate/methacrylic acid copolymer solids | 1.00–15.00 |

-continued

| Component | Weight Percent |
|---|---|
| Neutralizer | 0.10–1.00 |
| Plasticizer | 0.10–1.00 |
| Isopropanol | quantum sufficit |
| Purified water | 0.00–20.00 |
| Propellents (optional) | quantum sufficit |
| Fragrance and dye | quantum sufficit |
| | 100.00 |

wherein said working solution is permitted to dry after application to said textile fiber until the solvent has been substantially removed.

22. The coated textile fiber defined in claim 21, wherein said working solution is spray applied to the surface to be protected.

* * * * *